US005718610A

United States Patent [19]

Faber

[11] Patent Number: 5,718,610

[45] Date of Patent: Feb. 17, 1998

[54] CABLE CLAMP TERMINAL FOR A CIRCUIT INTERRUPTER

[75] Inventor: Timothy Robert Faber, Meylan, France

[73] Assignee: Square D Company, Palatine, Ill.

[21] Appl. No.: 839,415

[22] Filed: Apr. 14, 1997

Related U.S. Application Data

[63] Continuation of Ser. No. 512,730, Aug. 8, 1995, abandoned.

[51] Int. Cl.[6] ..... H01R 11/09

[52] U.S. Cl. ..... 439/797; 439/810; 411/187; 411/959

[58] Field of Search ..... 439/797, 798, 439/810, 814; 411/393, 308–311, 184, 187–189, 959, 957

[56] References Cited

U.S. PATENT DOCUMENTS

| | | | |
|---|---|---|---|
| 2,210,455 | 8/1940 | Hoskins | 411/187 |
| 2,830,635 | 4/1958 | Thorstens | 411/259 |
| 3,017,206 | 1/1962 | Johnson | 411/393 |
| 3,144,293 | 8/1964 | De Smidt | 439/797 |
| 3,355,685 | 11/1967 | Leonard | 335/8 |
| 4,466,691 | 8/1984 | Batteux | 439/797 |
| 5,030,131 | 7/1991 | Boehm | 439/810 |
| 5,127,784 | 7/1992 | Eslinger | 411/414 |

FOREIGN PATENT DOCUMENTS

| | | | |
|---|---|---|---|
| 1422935 | 1/1976 | United Kingdom | 439/797 |

*Primary Examiner*—Gary F. Paumen

*Attorney, Agent, or Firm*—Larry I. Golden; Kareem M. Irfan; Wayne H. Stoppelmoor

[57] ABSTRACT

A cable clamp terminal for use with an electrical apparatus is provided, the cable clamp terminal including a terminal block having a threaded hole defined therein. An intermediate screw and an upper screw are disposed in the threaded hole, whereby the intermediate screw divides the threaded hole into a lower housing and an upper housing. A lower opening extending through the terminal block and communicating with the lower housing provides access for an end of a corresponding lower cable to be positioned and secured in the lower housing. An upper opening extending through the terminal block and communicating with the upper housing provides access for an end of a corresponding upper cable to be positioned and secured in the upper housing. The lower cable can be secured in the lower housing by tightening the intermediate screw without removing the upper screw from the threaded hole.

32 Claims, 3 Drawing Sheets

CABLE CLAMP TERMINAL FOR A CIRCUIT INTERRUPTER

This is a continuation of application Ser. No. 08/512,730 filed Aug. 8, 1995, now abandoned.

FIELD OF THE INVENTION

This invention relates generally to an apparatus for connecting electrical cables to an electrical apparatus and, more specifically, to a cable clamp terminal for connection of electrical cables to an electrical apparatus such as a circuit interrupter.

BACKGROUND OF THE INVENTION

Electrical cables are coupled to circuit interrupters with various types of connector terminals. One typical arrangement of this type includes a terminal block fastened to a circuit interrupter lug. The terminal block has two superposed housings which are disposed to receive an end of a cable. Two setscrews are screwed into a tapped aperture which extends through the housings in the terminal block. A first cable is first inserted into a lower housing and an intermediate screw is tightened into the cable thereby wedging this cable against a bottom surface. A second cable is then inserted into an upper housing and an upper screw is tightened into the second cable thereby wedging the second cable between the intermediate screw and the upper screw. A problem with the prior art exist because the top screw must be removed from the terminal prior to tightening the intermediate screw into the first cable. It would be desirable to tighten the intermediate screw with the top screw remaining in the terminal.

SUMMARY OF THE INVENTION

It is a general object of the present invention to provide a connector assembly which connects an electrical cable to an electrical apparatus.

It is a more specific object of the present invention to provide a cable clamp terminal which provides the ability to install a lower cable without requiring the removal of an upper screw.

In accordance with a preferred embodiment of the present invention a cable clamp terminal for use with an electrical apparatus is provided including a terminal block having a threaded hole defined therein. An intermediate screw and an upper screw are disposed in the threaded hole, whereby the intermediate screw divides the threaded hole into a lower housing and an upper housing. A lower opening extending through the terminal block and communicating with the lower housing provides access for an end of a corresponding lower cable to be positioned and secured in the lower housing. An upper opening extending through the terminal block and communicating with the upper housing provides access for an end of a corresponding upper cable to be positioned and secured in the upper housing. The lower cable can be secured in the lower housing by tightening the intermediate screw without removing the upper screw from the threaded hole.

BRIEF DESCRIPTION OF THE DRAWINGS

Other objects and advantages of the invention will be apparent from the following detailed description and the accompanying drawings in which.

DETAILED DESCRIPTION OF THE PREFERRED EMBODIMENTS

For a better understanding of the present invention together with other and further advantages, and capabilities thereof, reference is made to the following disclosure and appended claims in connection with the above-described drawings.

Figure 1:
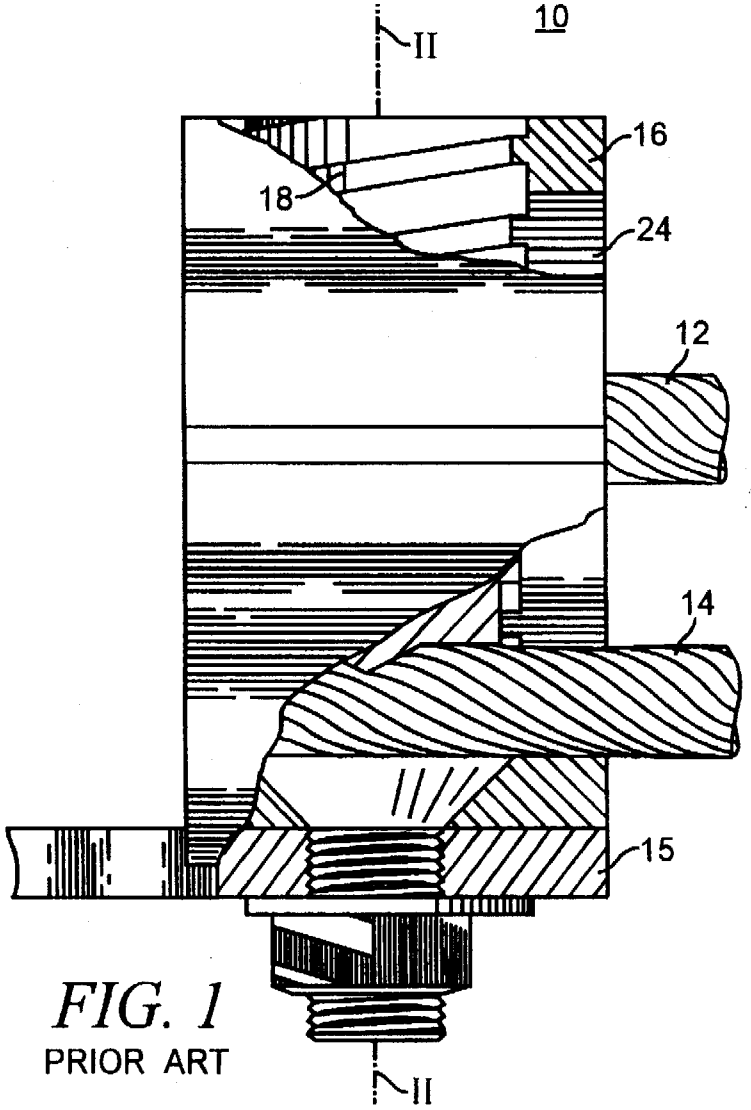
FIG. 1 PRIOR ART
FIG. 1 is an elevational view, partially cut-away, of a prior art wire clamp terminal.
Figure 2:
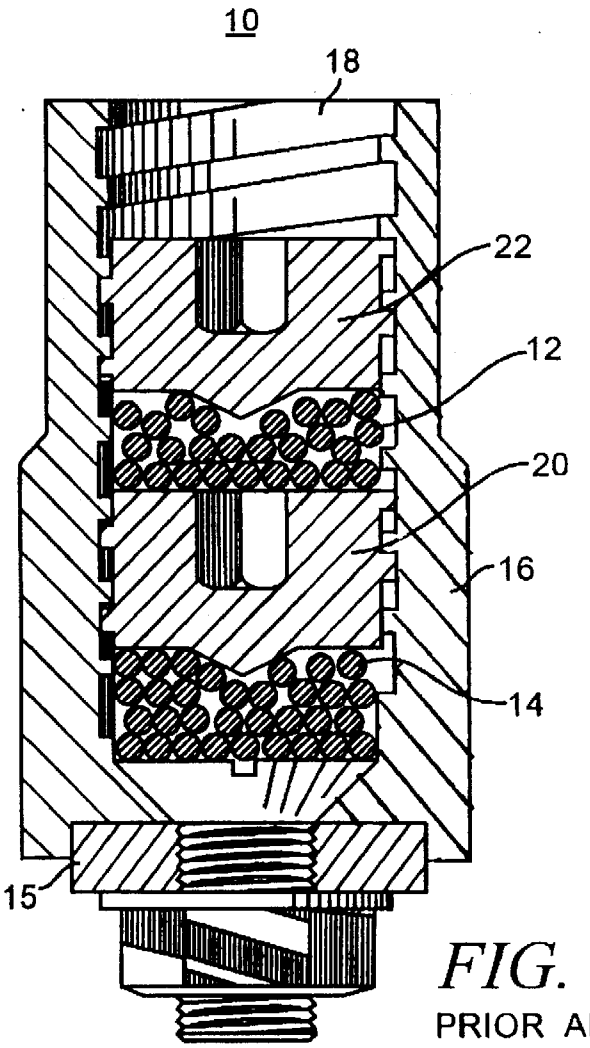
FIG. 2 PRIOR ART
FIG. 2 is a partial section view taken along the line II—II of FIG. 1.

FIGS. 1 & 2 show a prior art cable clamp terminal 10 for coupling an upper wire cable 12 and a lower wire cable 14 to a circuit breaker lug 15. The prior art terminal is disclosed in U.S. Pat. No. 4,466,691 entitled "Connecting Terminal for Circuit Interrupter," which the disclosure therein is incorporated by reference, and includes a terminal block 16 having a threaded hole 18 therein for receiving a threaded intermediate screw 20 and a threaded upper screw 22. The lower cable 14 is wedged between the intermediate screw 20 and the bottom of an elongated slot 24 which is perpendicular to the threaded hole 18 and passes through the terminal block 16. The upper cable 12 is wedged between the intermediate screw 20 and the upper screw 22. A disadvantage of the prior art terminal 10 is that the upper screw 22 must be removed prior to tightening the intermediate screw 20 into the lower cable 14.

Therefore, it would be desirable to provide a cable clamp terminal which allows the intermediate screw to be tightened without requiring the upper screw to be removed.

The present invention solves the problem of the prior art by allowing the intermediate screw to be tightened without requiring the upper screw to be removed from the terminal. The present invention also provides the advantage of increasing the gripping strength that the screws exert on the cables. Another advantage of the present invention is that it provides the ability to pierce oxides on the cables for assuring a good electrical connection.

Figure 3:
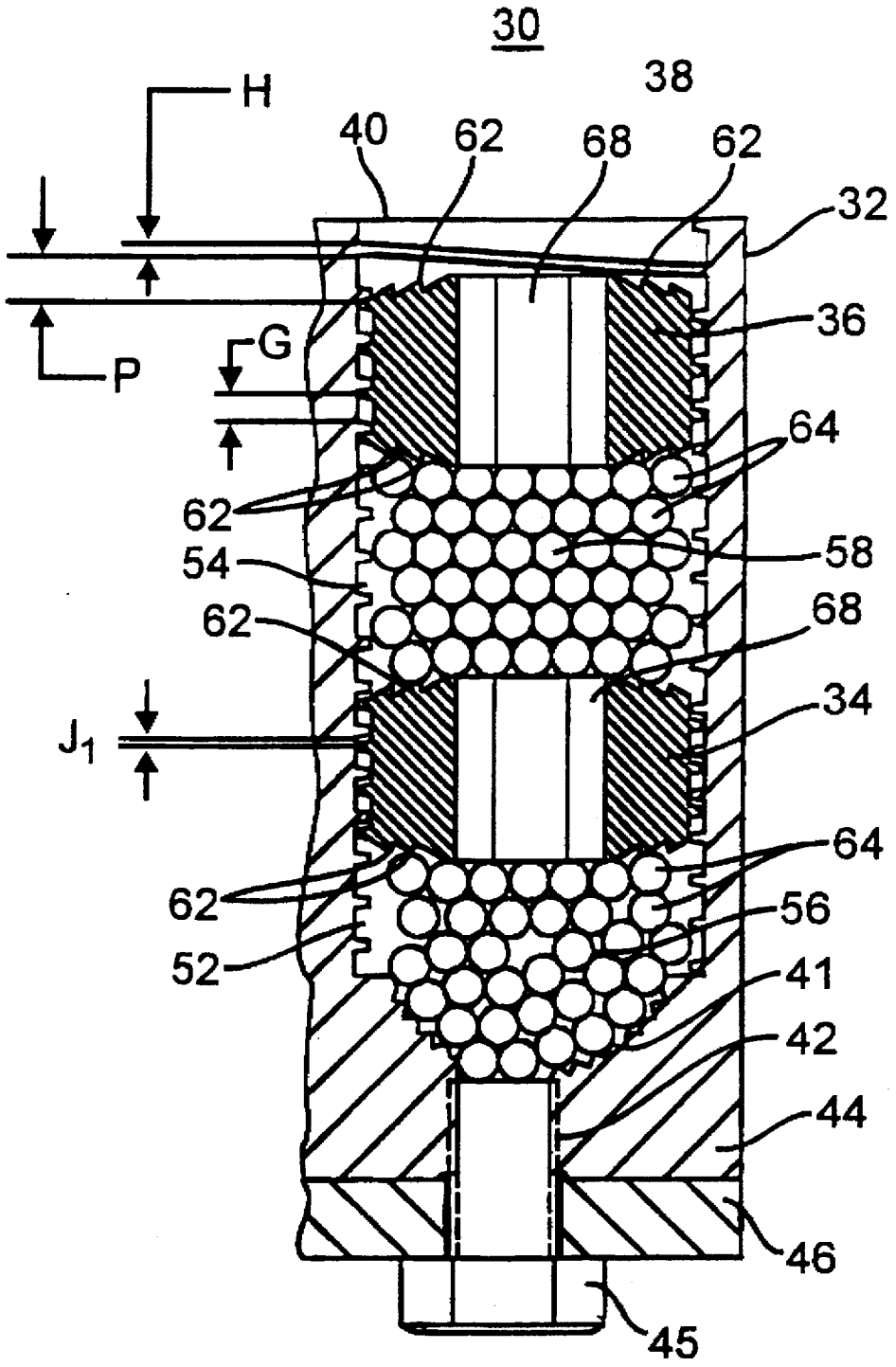
FIG. 3 is a partial section view of the preferred embodiment of the present invention.
Figure 4:
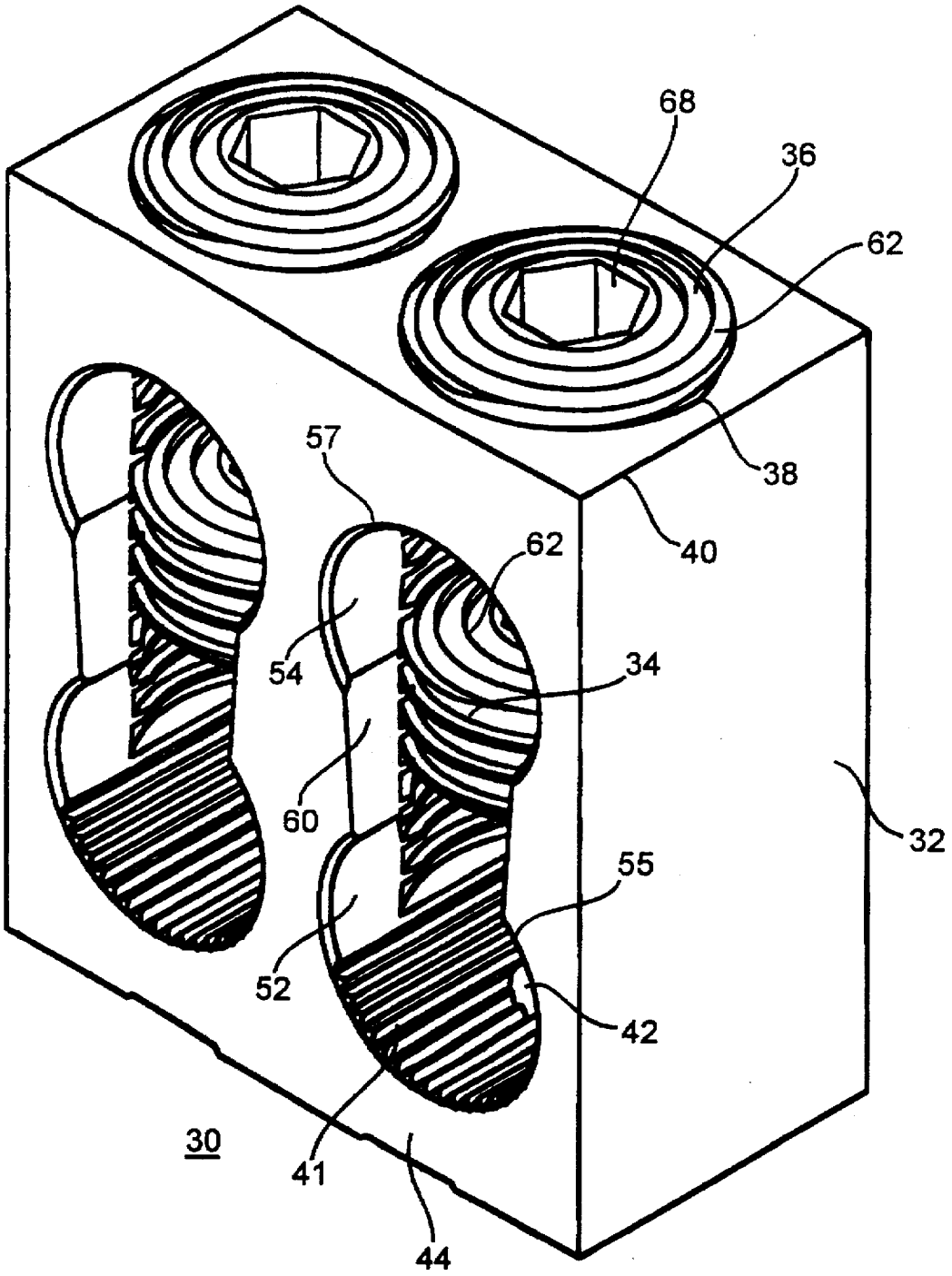
FIG. 4 is an isometric view of the present invention.

As shown in FIGS. 3 & 4, a preferred embodiment of a cable clamp terminal in accordance with the present invention is designated generally by reference character 30. As shown, the terminal 30 includes a generally rectangular shaped terminal block 32 and a pair of setscrews, an intermediate screw 34 and an upper screw 36, disposed in a threaded hole 38. The terminal block 32 and the setscrews 34, 36 are made out of electrically conductive material. In FIG. 4, the terminal block 32 is shown to include two sets of threaded holes 38 and setscrews 34, 36, however, only one set will be described in detail hereinbelow. The threaded hole 38 extends through an upper end 40 of the terminal block 32 and has a rounded serrated surface 41 disposed on its bottom surface. A threaded aperture 42 extends from the serrated surface 41 through a bottom end 44 of the terminal block 32 for receiving a bolt 45 (FIG. 3). The terminal 30 is mounted to a lug 46 (FIG. 3) disposed on a circuit breaker of the type disclosed in U.S. Pat. No. 3,355,685 entitled "Electric Circuit Breaker Having Improved Operating Means" which is assigned to the same assignee as the present application and the disclosure therein is incorporated by reference. The bolt 45 passes through the lug 46 and is threaded into the threaded aperture 42 to secure the terminal 30 to the lug 46.

The threaded hole 38 is sized to receive the screws 34, 36. The intermediate screw 34 splits the cavity defined by the threaded hole 38 into a lower housing 52 and an upper housing 54. A lower opening 55 (FIG. 4) extends through the terminal block 32 and communicates with the lower housing 52 to provide access for the end of a corresponding lower cable 56 (FIG. 3) to be positioned and secured in the lower housing 52. An upper opening 57 (FIG. 4) extends through the terminal block 32 and communicates with the upper housing 54 to provide access for the end of a corresponding upper cable 58 (FIG. 3) to be positioned and secured in the upper housing 54. In the preferred embodiment shown in FIGS. 3 & 4 the upper and lower housings 54, 52 are defined as part of an elongated slot 60 (FIG. 4) extending generally perpendicular to and communicating with the threaded hole 38.

The threading of the threaded hole 38 and the screws 34, 36 is of a modified ACME thread design having a thread angle of 29° and a thread thickness H (FIG. 3) being inferior to half of the thread pitch P (FIG. 3) so as to obtain a notable clearance thereby providing an axial gap G (FIG. 3) between the thread of the threaded hole 38 and the thread of the screws 34, 36. This gap G allows the screws to essentially float between the threads of the threaded hole 38. There are basically three factors of primary importance in developing the thread design, they are to i) provide strength to withstand the stresses placed on the screws 34, 36 during and after tightening them into the cables; ii) maximize the efficiency of the screws; and iii) reduce outward radial force being placed on the wall surface of the threaded hole 38 as compared to the radial force that a conventional 60° thread angle would place on the surface of the threaded hole, thereby preventing the wall from bulging outwardly and causing the screws to fail. Efficiency of the screw is defined as the amount of force pressing on the cables versus the torque required to turn the screw. Satisfying the above-identified requirements is very difficult because as the thread angle increases to increase the thread strength, the radial force increases and the efficiency decreases. A conventional buttress thread design having a 7° thread angle would have been an ideal solution to satisfy all three of the above-identified factors. However, the buttress thread design is asymmetrical and orientation sensitive thereby causing the screws to fail to meet design requirements if they were to be installed upside down. It is desirable to have a thread design that is symmetrical so that the screws may be installed in either direction. Therefore, an ACME thread design having a modified thread angle which is reduced from the conventional 60° is utilized in the preferred embodiment of the present invention to reduce radial force on the wall and to improve thread efficiency of the screws while maintaining a sufficient strength.

The screws 34, 36 are uniquely shaped to provide the advantage of having good cable clamping efficiency, high electrical resistance to stress relaxation and good cable pullout retention force. This feature is provided by stair-stepped concentric ridges 62 on the top and bottom surfaces of the screws 34, 36 for engaging strands 64 in the cables 54, 56. The ridges 62 on the bottom surface of the intermediate screw 34 complement the serrated surface 41 disposed on the bottom of the threaded hole 38. The combination of the concentric ridges 62 and the serrated surface 41 provides localized high pressure points for piercing oxides on the strands 64 of the lower cable 56 thereby insuring good electrical connection. The ridges 62 on the top surface of the intermediate screw 34 in combination with the ridges 62 on the bottom surface of the upper screw 36 provide localized high pressure points for piercing oxides on the strands 64 of the upper cable 58 thereby insuring good electrical connection. The serrated surface 41 and the ridges 62 also provide a tenacious grip thereby preventing the cables from pulling out of the terminal. As an additional advantage, the concentric ridges 62 provide generalized pressure distribution which prevents cold flow and cable relaxation thereby enhances heat transfer capabilities.

A hexagonal shaped bore 68 extending longitudinally through the screws 34, 36 provides yet another advantage. The bore is provided for inserting a tightening tool (not shown) therein for tightening the screws 34, 36 into the cables 54, 56. The advantage of the bore 68 is that the upper screw 36 does not need to be removed in order to tighten the intermediate screw 34, as is required by the prior art terminal 10. The bore 68 allows the tightening tool to pass through the upper screw 36 in order to be inserted into the bore of the intermediate screw 34.

To electrically couple the cables 54, 56 to the circuit breaker, the terminal 30 is positioned onto the lug 46 and the bolt 45 is threaded into the threaded aperture 42 from below the lug 46. The end of the lower cable 56 is then inserted into the lower housing 52. The tightening tool is passed through the bore 68 in the upper screw 36 and into the bore 68 in the intermediate screw 34. The tool is then turned clockwise thereby screwing the screws 34, 36 in unison into the threaded hole 38 with only the intermediate screw 34 exerting force on the lower cable 56. As the intermediate screw 34 exerts force on the lower cable 56, the strands 64 of the lower cable 56 are compressed. The ridges 62 on the bottom surface of the intermediate screw 34 and the serrated surface 41 on the bottom of the slot 60 pierce oxides on and compress the strands 64 of the lower cable 56 thereby securing the lower cable 56 in place. The tightening tool is then retracted from the intermediate screw 34 to allow the insertion of the upper cable 58 into the upper housing 54. The tightening tool is inserted into the bore 68 of the upper screw 36 and is rotated clockwise to tighten the upper screw 36 into the strands 64 of the upper cable 58. The ridges 62 on the upper surface of the intermediate screw 34 and on the bottom surface of the upper screw 36 pierce the oxides on and compress the strands 64 of the upper cable 58 thereby securely holding the upper cable 58 in place. As is shown in FIG. 3, the intermediate screw 34 is axially shifted creating a relatively weak longitudinal play $j_1$ between the threads of the intermediate screw 34 and the threads of the threaded hole 38 after the upper screw 36 is tightened into the upper cable 58.

It should be noted that the majority of the tightening force of the upper screw 36 is transferred through the upper cable 58 to the intermediate screw 34 and then to the lower cable 56 and finally to the serrated surface 41. If the tightening torque of the upper screw 36 is sufficient, there will be no load or stress in the threads of the intermediate screw 34. After the upper screw 36 is tightened to a sufficient torque, the intermediate screw 34 acts as a spacer between the upper and lower cables and a transmitter of the tightening force from the upper screw 36 to the lower cable 56. The intermediate screw 34 also provides resistance to cable pullout forces commonly associated with circuit breakers. Due to the coordination of the screw size, thread design and the ridges 62 on the upper and lower surfaces of the screws, pullout of the cables from the terminal assembly is prevented.

After a period of time during which the terminal 30 has gone through repeated thermal cycles and compression of the cable strands 64, retightening is required to maintain a proper gripping force on the cables 54, 56. This retightening is accomplished by retightening the upper screw 36 into the upper cable 58. Due to the play $j_1$ (FIG. 3) the retightening force is transmitted to the lower cable 56 through the intermediate screw 34 which is pushed downward resulting in a play of a value superior to the one of $j_1$. Therefore, retightening of the intermediate screw 34 is accomplished by retightening the upper screw 36 due to the thread design which allows axial sliding of the intermediate screw 34.

While there have been shown and described what is at present considered the preferred embodiment of the invention, it will be obvious to those skilled in the art that various changes and modifications may be made therein without departing from the scope of the invention as defined by the appended claims. For example, although only one combination of screws and threaded hole has been shown in FIG. 4 and described in detail, it would be obvious that any number of combinations could be used. Additionally, although it has been shown and described that both screws have a bore extending entirely therethrough, it is possible to have a terminal where only the upper screw has a bore extending therethrough and the intermediate screw has a hexagonal shaped recess for accepting the end of the tightening tool. Additionally, it is not required that the top surface of the upper screw have concentric ridges thereon.

What is claimed is:

1. A cable clamp terminal for connecting cables to an electrical apparatus, said terminal comprising:

a terminal block having a threaded hole defined therein;

an intermediate screw and an upper screw disposed in said threaded hole, said intermediate screw dividing said threaded hole into a lower housing and an upper housing;

a lower opening extending through said terminal block and communicating with said lower housing to provide access for one end of a lower cable to be positioned and secured in said lower housing; and an upper opening extending through said terminal block and communicating with said upper housing to provide access for one end of an upper cable to be positioned and secured in said upper housing;

both said intermediate and upper screws including apertures longitudinally extending therethrough and having substantially the same size and shape to be capable of accommodating a tightening tool in operative engagement with both screws so that the same tool may be used to (i) install and tighten both screws and correspondingly secure both said upper and lower cables, and (ii) tighten said intermediate and upper screws in unison to secure said lower cable without removing said upper screw.

2. A cable clamp terminal as claimed in claim 1, whereby said upper screw having a longitudinal hole therethrough for allowing access to tighten said intermediate screw in order to secure the lower cable within said lower housing without removing said upper screw.

3. A cable clamp terminal as claimed in claim 1, wherein said intermediate screw having threads which provide for longitudinal play relative to said threaded hole, thereby allowing a limited axial sliding of said intermediate screw.

4. A cable clamp terminal as claimed in claim 3, wherein said intermediate screw further having a plurality of concentric ridges on its top and bottom surfaces.

5. A cable clamp terminal according to claim 4, wherein said upper screw further having a plurality of concentric ridges on its bottom surface.

6. A cable clamp terminal according to claim 3, wherein said threads are an ACME form having a thread angle less than 60°.

7. A cable clamp terminal as claimed in claim 1, wherein said lower housing having a bottom surface which is serrated.

8. A cable clamp terminal as claimed in claim 1, wherein said intermediate screw further having a plurality of concentric ridges on its top and bottom surfaces.

9. A cable clamp terminal according to claim 8, wherein said upper screw further having a plurality of concentric ridges on its bottom surface.

10. A cable clamp terminal for connecting cables to an electrical apparatus, said terminal comprising:

a terminal block having a threaded hole defined therein;

an intermediate screw and an upper screw disposed in said threaded hole, said intermediate screw dividing said threaded hole into a lower housing and an upper housing;

a lower opening extending through said terminal block and communicating with said lower housing to provide access for one end of a lower cable to be positioned and secured in said lower housing; and an upper opening extending through said terminal block and communicating with said upper housing to provide access for one end of an upper cable to be positioned and secured in said upper housing;

both said intermediate and upper screws including apertures longitudinally extending therethrough and having substantially the same size and shape to be capable of accommodating a tightening tool in operative engagement with both screws so that the same tool may be used to (i) install and tighten both screws and correspondingly secure both said upper and lower cables, and (ii) tighten said intermediate and upper screws in unison to secure said lower cable without removing said upper screw.

11. A cable clamp terminal as claimed in claim 10, wherein said intermediate screw having threads which provide for longitudinal play relative to said threaded hole, thereby allowing a limited axial sliding of said intermediate screw.

12. A cable clamp terminal as claimed in claim 11, wherein said intermediate screw further having a plurality of concentric ridges on its top and bottom surfaces.

13. A cable clamp terminal according to claim 12, wherein said upper screw further having a plurality of concentric ridges on its bottom surface.

14. A cable clamp terminal according to claim 11, wherein said threads are an ACME form having a thread angle less than 60°.

15. A cable clamp terminal as claimed in claim 10, wherein said lower housing having a bottom surface which is serrated.

16. A cable clamp terminal as claimed in claim 10, wherein said intermediate screw further having a plurality of concentric ridges on its top and bottom surfaces.

17. A cable clamp terminal according to claim 16, wherein said upper screw further having a plurality of concentric ridges on its bottom surface.

18. A cable clamp terminal for connecting cables to an electrical apparatus, said terminal comprising:

a terminal block having a threaded hole defined therein;

an intermediate screw and an upper screw disposed in said threaded hole, said intermediate screw dividing said threaded hole into a lower housing and an upper housing;

said intermediate screw having threads which provide for longitudinal play relative to said threaded hole, thereby allowing a limited axial sliding of said intermediate screw;

a lower opening extending through said terminal block and communicating with said lower housing to provide access for one end of a lower cable to be positioned and secured in said lower housing; and an upper opening extending through said terminal block and communicating with said upper housing to provide access for one end of an upper cable to be positioned and secured in said upper housing;

both said intermediate and upper screws including apertures longitudinally extending therethrough and having substantially the same size and shape to be capable of accommodating a tightening tool in operative engagement with both screws so that the same tool may be used to (i) install and tighten both screws and correspondingly secure both said upper and lower cables, and (ii) tighten said intermediate and upper screws in unison to secure said lower cable without removing said upper screw.

19. A cable clamp terminal as claimed in claim 18, whereby said upper screw having a longitudinal hole therethrough for allowing access to tighten said intermediate screw in order to secure the lower cable within said lower housing without removing said upper screw.

20. A cable clamp terminal as claimed in claim 18, wherein said intermediate screw further having a plurality of concentric ridges on its top and bottom surfaces.

21. A cable clamp terminal according to claim 20, wherein said upper screw further having a plurality of concentric ridges on its bottom surface.

22. A cable clamp terminal according to claim 18, wherein said threads are an ACME form having a thread angle less than 60°.

23. A cable clamp terminal as claimed in claim 18, wherein said lower housing having a bottom surface which is serrated.

24. A cable clamp terminal for connecting cables to an electrical apparatus, said terminal comprising:

a terminal block having a threaded hole defined therein;

an intermediate screw, disposed in said threaded hole, having at least one concentric ridge disposed on top and bottom surfaces thereof, said intermediate screw divides said threaded hole into a lower housing and an upper housing, said lower housing having a bottom surface which is serrated;

an upper screw, disposed in said threaded hole, having at least one concentric ridge disposed on a bottom surface thereof;

a lower opening extending through said terminal block and communicating with said lower housing to provide access for an end of a corresponding lower cable to be positioned and secured in said lower housing; and an upper opening extending through said terminal block and communicating with said upper housing to provide access for an end of a corresponding upper cable to be positioned and secured in said upper housing.

25. A cable clamp terminal as claimed in claim 24, whereby said upper screw having a longitudinal hole therethrough for allowing access to tighten said intermediate screw in order to secure the lower cable within said lower housing without removing said upper screw.

26. A cable clamp terminal as claimed in claim 24, wherein said intermediate screw having threads which provide for longitudinal play relative to said threaded hole, thereby allowing a limited axial sliding of said intermediate screw.

27. A cable clamp terminal according to claim 26, wherein said threads are an ACME form having a thread angle less than 60°.

28. A cable clamp terminal as claimed in claim 26, whereby said upper screw having a longitudinal hole therethrough for allowing access to tighten said intermediate screw in order to secure the lower cable within said lower housing without removing said upper screw.

29. A cable clamp terminal for connecting cables to an electrical apparatus, said terminal comprising:

a terminal block having a threaded hole defined therein;

an elongated slot extending generally perpendicular to said threaded hole, said elongated slot having a serrated bottom surface;

two threaded setscrews adapted to be secured into said threaded hole, one of said setscrews being an intermediate screw for securing an end of a lower cable inserted between said serrated bottom surface and said intermediate screw, and the other of said setscrews being an upper screw for securing an end of an upper cable inserted between said intermediate screw and said upper screw;

whereby said intermediate screw having threads which provide for longitudinal play relative to said threaded hole, thereby allowing a limited axial sliding of said intermediate screw;

at least one ridge, disposed on a bottom surface of said intermediate screw, for cooperating with said serrated bottom surface in securing the lower cable between said serrated bottom surface and said intermediate screw;

at least one ridge, disposed on a top surface of said intermediate screw;

at least one ridge, disposed on a bottom surface of said upper screw, for cooperating with said at least one ridge on the top surface of said intermediate screw in securing the upper cable between said intermediate screw and said upper screw; and both said intermediate and upper screws including apertures longitudinally extending therethrough and having substantially the same size and shape to be capable of accommodating a tightening tool in operative engagement with both screws so that the same tool may be used to (i) install and tighten both screws and correspondingly secure both said upper and lower cables, and (ii) tighten said intermediate and upper screws in unison to secure said lower cable without removing said upper screw.

30. A cable clamp terminal according to claim 29, wherein said threads on said intermediate screw are a modified ACME design.

31. A cable clamp terminal according to claim 30, wherein said threads having a thread angle that maximizes the strength and efficiency of said setscrews while minimizes the radial force of said setscrews.

32. A cable clamp terminal according to claim 31, wherein said thread angle is less than 60°.

* * * * *